United States Patent [19]

Egly

[11] Patent Number: 4,588,321

[45] Date of Patent: May 13, 1986

[54] MAGNETIC MEDIA AND PROGRAM CASE

[76] Inventor: Robert A. Egly, 38 Whitewater Dr., Corona del Mar, Calif.

[21] Appl. No.: 618,530

[22] Filed: Jun. 8, 1984

[51] Int. Cl.[4] ..... B42F 13/00

[52] U.S. Cl. ..... 402/77; 402/502

[58] Field of Search ..... 206/45.18, 311, 425, 206/444; 40/405, 361; 281/1 R, 15 R, 18, 24, 31; 402/70, 77, 502

[56] References Cited

U.S. PATENT DOCUMENTS

| | | | |
|---|---|---|---|
| 3,688,898 | 9/1972 | Stanton | 206/311 |
| 4,011,940 | 3/1977 | Neal et al. | 402/70 X |
| 4,255,872 | 3/1981 | Williams, Sr. | 206/387 X |
| 4,332,400 | 6/1982 | Hagman | 281/18 X |
| 4,449,628 | 5/1984 | Egly et al. | 206/425 X |
| 4,508,366 | 4/1985 | Brindle | 281/2 X |

FOREIGN PATENT DOCUMENTS

| | | | |
|---|---|---|---|
| 2014721 | 12/1971 | Fed. Rep. of Germany | 206/425 |

*Primary Examiner*—Paul A. Bell

*Attorney, Agent, or Firm*—George F. Bethel; Patience K. Bethel

[57] ABSTRACT

The following specification sets forth a magnetic media and program storage case that is formed substantially from a single injection molded container. The injection molded container is formed with two major faces or covers and a binding or spine therebetween having a living hinge holding said major covers. An end closure or flap is hinged to one of the major covers by a living hinge. The flap incorporates tabs having tangs or barbs thereon for insertion within openings within the edge region of one of the covers. One of the major covers has a ring binder connected thereto for receipt of printed documentation in the form of a program, while said magnetic media is stored within a pocket including a pocket flap or cover that is attached to one of said major interior cover surfaces. The attachment can be by means of insertion tabs within an undercut channel or groove of said major cover. The foregoing provides for an entire cover for a printed program or instructions and magnetic media associated therewith.

10 Claims, 9 Drawing Figures

MAGNETIC MEDIA AND PROGRAM CASE

BACKGROUND OF THE INVENTION

The background of this invention resides within the magnetic media and storage art. More particularly, it resides within the art of maintaining magnetic media to be used with computers in conjunction with the hard copy software or directions associated therewith in the form of documented or printed form.

THE PRIOR ART

The prior art with regard to maintaining magnetic media in certain configurations involves certain plastic boxes, packaging, cardboard holders, shelving, sleeves and other related items specifically for magnetic media. It is believed that some of the closest art with regard to the related magnetic media holding means and configuration of this invention involves U.S. Pat. No. Des. 251,273, U.S. Pat. Nos. 4,225,038, 4,289,235 4,369,879 and 4,449,628 which the inventor hereof was an inventor thereof.

Some of the foregoing patents specifically were directed toward the idea of utilizing an easel type of configuration for holding a particular number of magnetic media. The easel type of configuration held the magnetic media behind tabs and allowed the exposure of the magnetic media by bending it foward against the tabs.

The easel configuration has been substituted in some cases by a one piece unit which has the tabs and does not have the easel configuration, but rather holds the magnetic media on the rear wall of the enclosure. In this particular configuration the user must sort through the magnetic media in a position which faces slightly downwardly and pull out whatever magnetic media is desired.

The foregoing means for holding magnetic media such as floppy disks, diskettes, magnetic cards and other magnetic media for the computer and related industry, did not direct itself to the holding of programs, associated directions, or printed material in any hard copy form. Oftentimes, magnetic media and printed directions or programs are associated with each other with regard to the magnetic media and the program in hard copy or printed form.

In other words, a particular program oftentimes is printed out or has directions pertaining thereto that have been printed in the way of hard copy or printed materials. The program or directions are written in either program language and/or plain English usage in a certain text. Also, the program can be printed out in the form of descriptions of how to use the program, as well as specific directions associated with the utilization of the program in association with the magnetic media.

The magnetic media in association with the hard copy or text of the program is usually separated. In other words, one is usually displaced from the other and oftentimes stored in different locations. This has caused problems with regard to associating the hard copy, text, or directions with the magnetic media pertaining thereto.

As can be appreciated, when one is not associated with the other, it can become lost, and also cannot be readily used. This invention allows a maintenance of the magnetic media and hard copy or printed directions and programs to be retained in one particular cover or case. To this extent, the magnetic media is implaced in the case of this invention and in direct association with printed copy, hard copy, directions, or associated text of the program, including the program itself. Thus, both are maintained in a neat and compatible case wherein the insertion of the magnetic media into the case is always in conjunction with the program in printed form being held therein.

This enables one to immediately pick a program by the case and insert the magnetic media into a computer or other associated equipment. Thereafter, the hard copy or printed form can be reviewed in light of the magnetic media and the program can be executed from the written text. Also, the directions and format of the program can be established from the written text in order to enhance the overall function and operation of the computer or associated memory system by the operator.

As can be seen, the magnetic media and program case of this invention is a substantial step over the prior art and enhances the overall value and effect in the use of programs and magnetic media associated therewith.

Accordingly, this invention should be read broadly in light of the prior art as being a step thereover in the way of storage and maintenance of magnetic media and associated programs or directions.

SUMMARY OF THE INVENTION

In summation, this invention comprises a unique case which holds magnetic media for use in a computer or associated equipment, such as a disk drive, and a program in textual form or directions pertaining to the magnetic media in association therewith and provides for the folding of the case into a configuration with a closure on one side thereof and a binding at the other.

More particularly, the invention comprises a magnetic media storage case having two major covers in connected relationship along a binding or spine thereof. The two major covers are injection molded in a single configuration with the binding or spine and living hinge connecting the two major covers.

On one major cover, a magnetic media storage pocket is provided. The magnetic media storage pocket has a flap type cover with attachment tabs, and can be opened to allow the insertion of magnetic media therein. In conjunction therewith, a ring binder is provided, or other holding means in order to secure a plurality of printed pages therein, which can contain text or other descriptions and directions with regard to the program.

The side opposite from the binding comprises an end closure. The end closure is a flap attached to the cover by means of a living hinge.

As the covers with the binding are folded together with the two major covers overlying each other, the end closure opposite from the binding comes together with one of the major covers and secures itself thereto by means of tabs having tangs that are inserted into one of the covers. The covers are formed with a flange around the periphery thereof for the reinforcement of the covers. A channel interiorly of one of the covers provides for receipt of the magnetic media pocket flap for the insertion thereof with its attachment tabs into the channel.

The entire case when closed allows for a covering of the magnetic media in a dustfree case, while at the same time holding the printed program or directions in a ring binder configuration. As a consequence, the entire combination allows for the enhancement and utilization of magnetic media for computer programs in conjunction with the directions, programs or printed textual material pertaining thereto.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
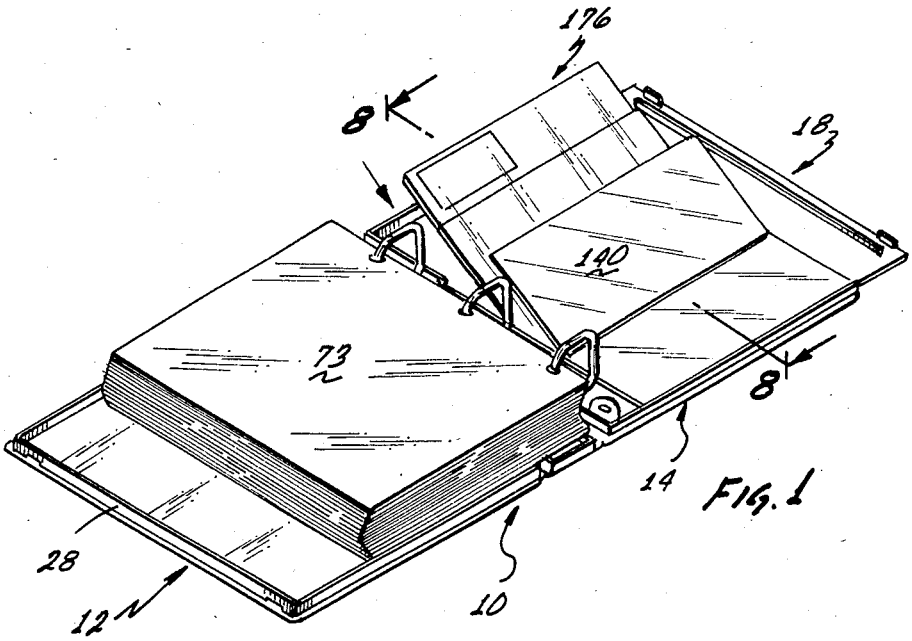
FIG. 1 shows a perspective view of the magnetic media and program storage case of this invention in its opened form with magnetic media being inserted into the pocket thereof and printed material in the ring binder.
Figure 2:
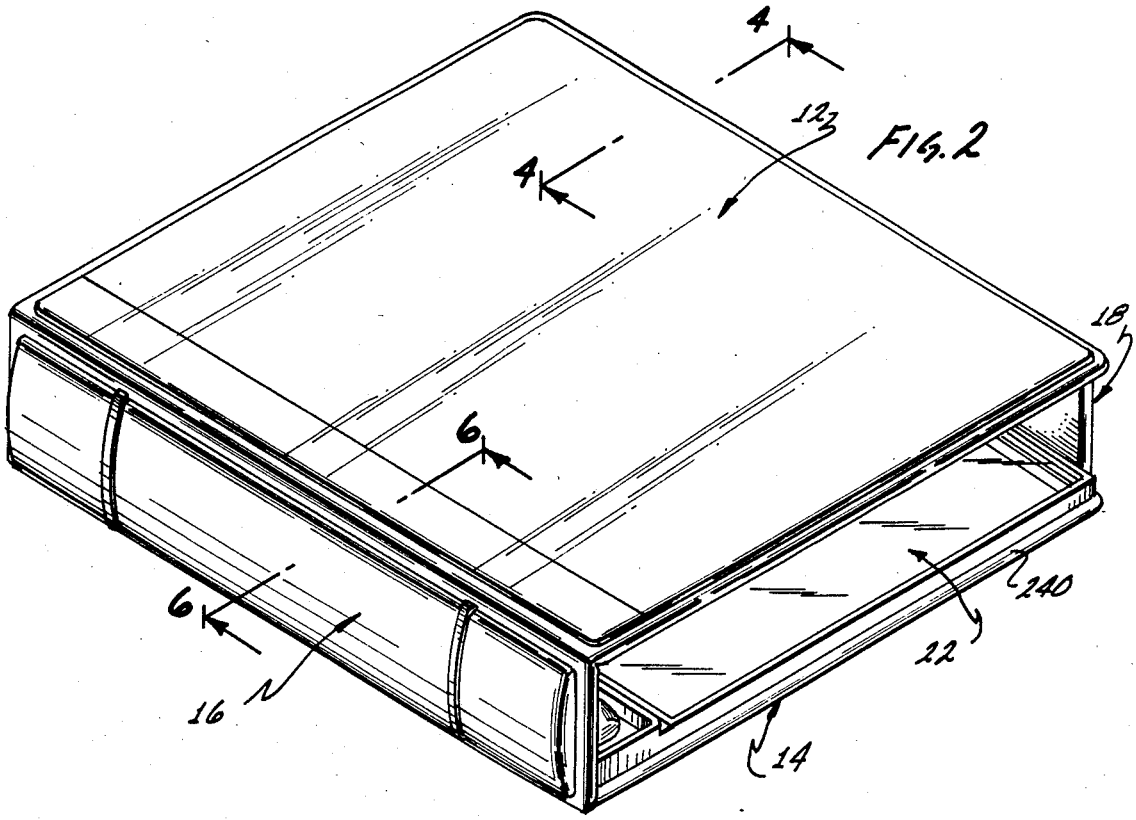
FIG. 2 shows a perspective view of the magnetic media and program storage case in its folded position.

Looking at the figures in detail, it will be seen that FIG. 1 shows the magnetic memory and program case of this invention. Specifically, it shows the magnetic memory case and program storage case in the form of a laid-out container or case 10. The case 10 can fold together, as can be seen in FIG. 2. The case 10 has a pair of first and second major covers 12 and 14. The major covers 12 and 14 fold together by means of a spine or binding 16 into a booklike configuration. The booklike configuration forms a case that fundamentally surrounds the contents and is closed by means of a closure or flap 18 at the opposite end of the binding or spine 16.

The entire container or case 10 when folded together has two open ends 22 and 24. The open ends 22 and 24 can be provided with flaps, walls, or covers of any type in upstanding relationship between the major covers 12 and 14. In other words, the second major cover 14 or the opposite first cover 12 can have walls extending therefrom in whatever configuration is desired in order to encapsulate and hold the materials therein. However, it is thought that in the particular embodiment shown herein it is not necessary to have any closures between covers 12 and 14. Nevertheless, in some cases, it would be deemed desirable and could fit in the space between the two first and second major covers 12 and 14 when they are closed, in order to establish a closure along the ends thereof.

The two major first and second covers 12 and 14 can be designated as a top cover and bottom cover, inasmuch as when shown in FIG. 2 they are in a top and bottom cover relationship. This would be true as to the way the relationship of the container 10 is shown in the drawings. However, it should be understood that either top or bottom cover can be substituted one for the other by merely reversing the relationship. As a consequence, for purposes of convention, the two major covers 12 and 14 will be merely referred to as the major covers or respectively first and second covers, which would be interchangeable as to their outer major surfaces.

The first major cover 12 has a spline, rib or ridge 28 that surrounds the outer area thereof. The spline or ridge 28 comprises an outer wall portion 30, an inner wall portion 32, a lateral wall portion 34 and a second lateral wall portion 36. The spline or ridge 28 in the outer or peripheral area 30 is provided with two openings 38 and 40. The two openings 38 and 40 are implaced therein to receive a tab with a tang or barb on the end of it as will be described hereinafter. This allows the end closure 18 to be received therein and held along the edge portions of the container when it is closed.

The binding or spine 16 is formed in a manner whereby it is injection molded with a living hinge. As can be seen in greater detail in FIGS. 6 and 7, and first living hinge 42 is shown at one side of the spine 16 and a second living hinge 44 on the other. Both of the foregoing living hinges are molded at the same time with the entire container as shown herein as container or case 10. The hinges 42 and 44 are of a thin wall section and allow for the flexibility of the first and second covers 12 and 14 to be bent with regard to the spine 16.

The spine 16 has a rib or box channel flange 48. This rectangular flange has elongated portions 50 and 52 with end portions 54 and 56. This provides for reinforcement of the spine 16 so that it will maintain a degree of rigidity along the back of the spine. It should be noted that any substitute rigidifying rib or flange can be utilized. Furthermore, the rib or flange can be divided up into variously ribbed and flanged configurations in any particular configuration or segments in order to provide the rigidity of the spine 16 as required.

The spine 16 has a plurality of dimples 60, 62 and 64 which receive respective rings 66, 68 and 70 that are connected to and are part of a ring binder 72 for holding printed sheets 73. Thus, when the container 10 is closed, the rings 66, 68 and 70 are received in the dimples of the spine 16 so as to provide for a degree of spacing therefor.

The ring binder 72 is of a standard ring binder configuration formed of a metal strip 74 turned downwardly in an arcuate manner and attached by plastic pins 76 and 78 that are heat staked into openings of the ring binder 72. The heat staked pins can be molded in situ with the second cover 14 or spine 16 and can be substituted by bolts, rivets, or other fastening means holding the ring binder 72 to the cover 14, or alternatively to the spine 16.

The rings 66, 68 and 70 in the ring binder 72 are spring loaded and can be opened and closed along a dividing line 80 thereof. There is nothing significant about the rings or the ring binder itself beyond that of the state of the art, except as it is used with regard to the case or container 10 hereof. Thus, any binder or holding means is within the purview of this invention to hold printed programs or direction sheets 73. This extends to edge clamps, spring clamps and plastic insert bindings for holding sheets 73.

In order to receive the ring binder and provide certain reinforcement, a rectangular receipt area 84 is utilized comprising elongated walls 86 and 88 and outer lateral walls 90 and 92. The foregoing walls 86, 88, 90 and 92 provide for rigidity of the area surrounding the ring binder 72.

In order to provide for rigidity and strength of the second major cover 14, an outer flange, rib or spline 98 is provided having an outer elongated rib wall 100, and an inner elongated rib wall 102.

Lateral elongated rib walls 102 and 104 are provided having a configuration which joins the walls 100 and 102 to provide for a complete peripheral flange or rectangular walled rib portion 98.

The elongated walls 100 and 102 have a step therein which can be seen as a lower walled portion at steps 110 and 112. This can be seen substantially within the showing of FIG. 8 wherein the step is stepped down to the lowered wall portion 102. The foregoing allows for a pocket for magnetic media to be provided as shown as will be detailed hereinafter.

The second cover 14 has a channel provided adjacent the walls 100, 102 and 106 by means of an inner wall. This inner channel wall can be seen in FIGS. 4, 5, 6 and 7. In particular, it can be seen wherein an inner channel wall 120 is shown interiorly of the outer wall 100. The outer wall 100 serves to receive a top cover or a pocket as will be described hereinafter.

Figure 6:
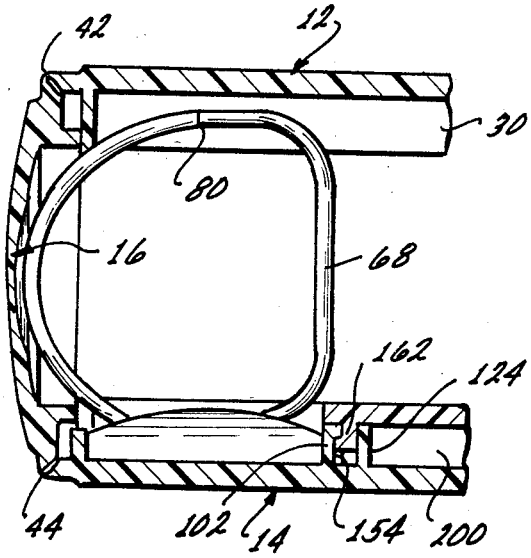
FIG. 6 shows a sectional view in the direction of lines 6—6 of FIG. 2 detailing the binding or spine and the ring binder for the program.
Figure 7:
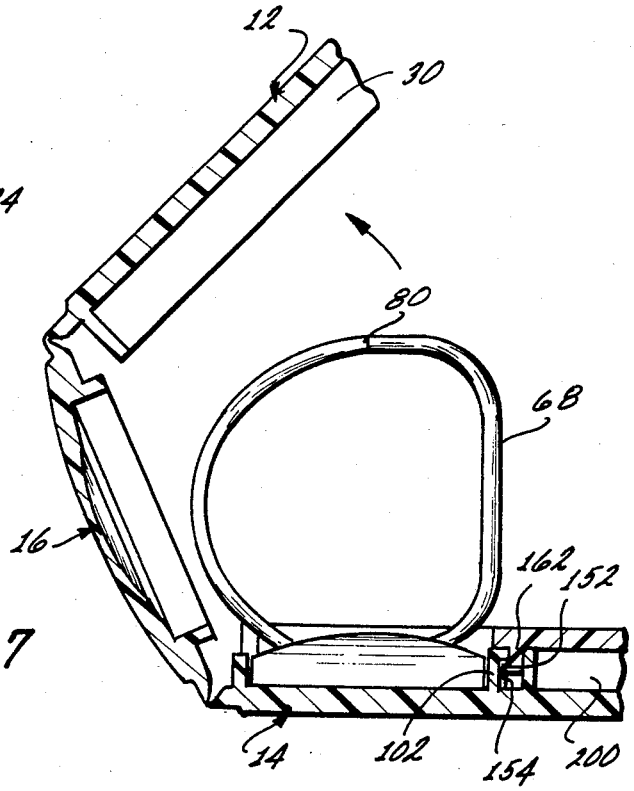
FIG. 7 shows the sectional view of FIG. 6 with the magnetic media storage and program case being opened.

A second inner wall can also be seen as inner wall 124 adjacent the outer wall 102 of FIGS. 6 and 7.

Figure 8:
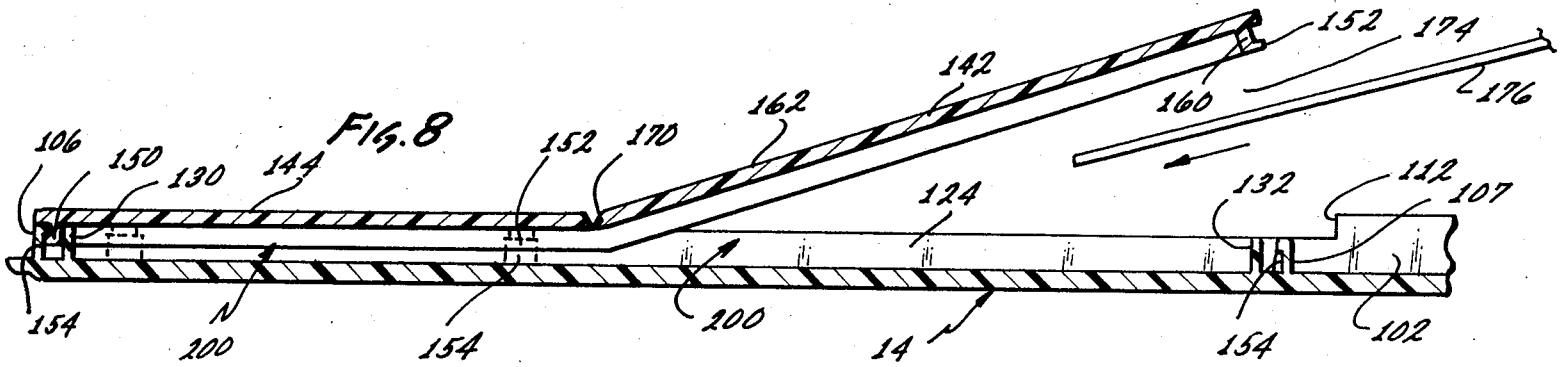
FIG. 8 shows a sectional view looking in the direction of lines 8—8 of FIG. 1 with the magnetic media being inserted into the magnetic media pocket; and, FIG. 9 shows an alternative view of a pocket that has been placed in the case for the receipt of material therein in a different configuration from the foregoing figures.

Looking more specifically at FIG. 8, it can be seen wherein inner walls 130 and 132 are shown in conjunction with outer wall 106 and outer wall 107, which spans the area between walls 100 and 102. These provide for a channel between walls 106 and 130, and walls 107 and 132.

The foregoing channel adjacent walls 100, 102, 106 and 107 allows for a receipt of a pocket flap cover or overlay, as will be described hereinafter. The pocket flap can be seen as a pocket flap 140 having an upper hinged portion 142 and a lower fixed portion 144 that can be respectively called a hinged portion 142 and fixed portion 144 when in use.

The two respective hinged and fixed portions are held in a channel provided between inner walls 130 and 132 and the outer wall 106 and 107, as well as the outer walls 100 and 102 and the inner walls 120 and 124. The channel receives a ridge or rib of the pocket cover 140 formed by walls 150, 160, 162 and 164.

The foregoing securement is accomplished by the walls 150, 160, 162 and 164 having protuberances or tabs. This is exemplified in the form of the wall 150 having a protuberance 152 extending therefrom which is received within an inset or recess 154 providing an interior ledge receiving the protuberance, tab or tang.

The recess 154 is such wherein it underlies the top surface of the outer walls 100,102 and 106 and 107. This recess 154 can be seen in FIGS. 4, 5, 6, 7 and 8.

The peripheral wall portions 160 shown opposite from peripheral wall portion 150, as well as lateral peripheral wall portions 162 and 164 also serve to rigidify the pocket cover 140. All the wall portions 150, 160, 162 and 164 have like tabs or tangs 152 that seat in the undercut or openings 154.

Figure 3:
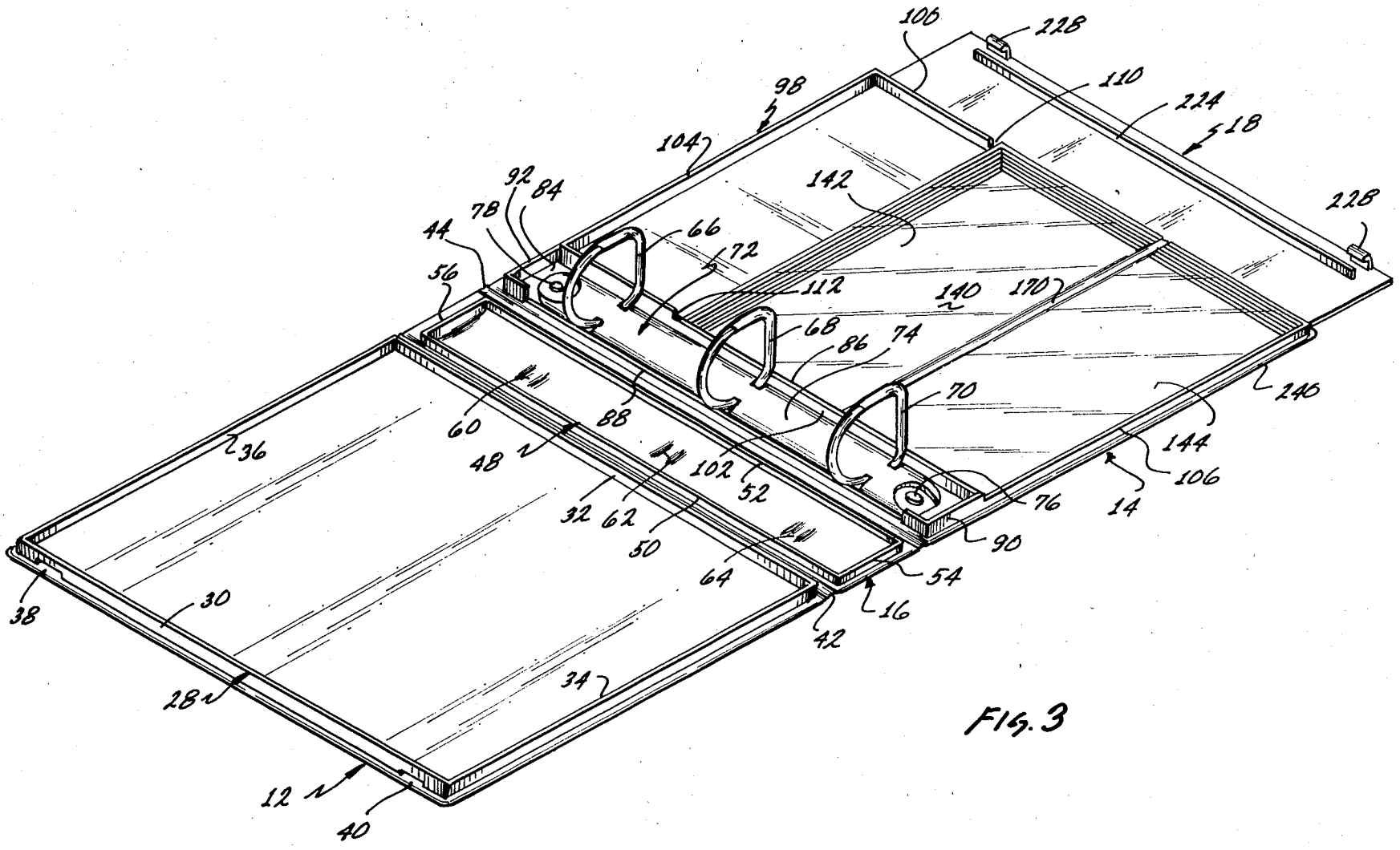
FIG. 3 shows a detailed perspective view of the magnetic media storage case of this invention unfolded, without the text or program thereof being held by the ring binder.
Figure 4:
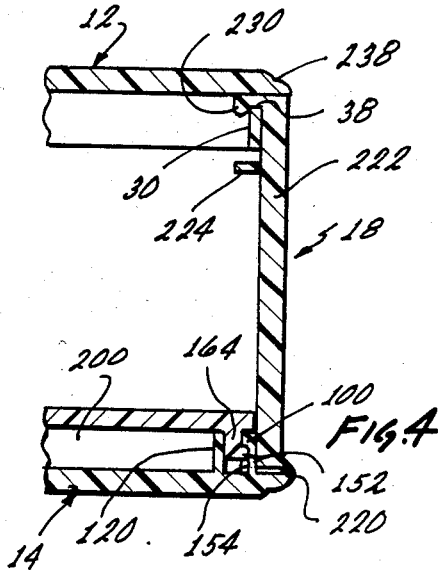
FIG. 4 shows a sectional view of the end closure in the direction of lines 4—4 of FIG. 2.
Figure 5:
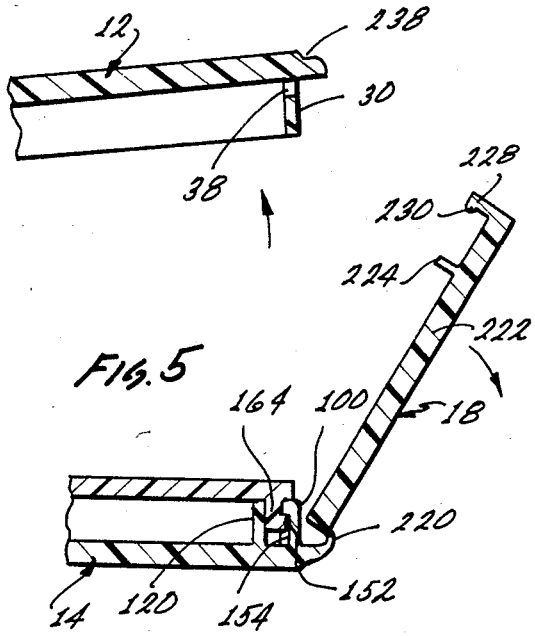
FIG. 5 shows the closure of FIG. 4 being opened.

The fixed pocket cover portion 144 is hinged to hinged pocket cover portion 142, along a living hinge 170 which can be seen in FIG. 8 and FIG. 3. This hinged portion 142 permits the pocket to be opened along the living hinge 170 to permit access by means of a space 174 created therebetween so that magnetic media in the form of magnetic media 176 as shown can be inserted therein. The magnetic media 176 can be of any suitable type, such as floppy disks, disks, diskettes, cards, or any other magnetic elements suitable for placement and enclosure within the pocket created by the pocket cover 140 between the walls 130, 132 and 120 and 124.

As can be seen from the foregoing, the pocket cover 140 with its hinged portion 142 and fixed portion 144 are both secured by means of the protuberances or tabs 152 extending from the walls 150, 160, 162 and 164 into recesses 154. These protuberances 152 extend into openings or recesses 154 formed to provide a ledge into which the protuberances 152 can extend on the outer walls 100, 102, 106 and intermediate wall 107.

Thus, a portion of the pocket cover 140, i.e., hinged portion 142, can be moved upwardly and downwardly in a facile manner while retaining the fixed portion 144 overlying the second cover 14 and allowing the insertion of magnetic media 176 into the pocket provided thereby. This specifically enhances the closure, storage and dustfree and non-contaminating environment for magnetic media. As can be seen in the figures, a space 200 is provided within the pocket overlying cover 14 that once closed is secured by means of the overlying pocket cover 140 on the underlying wall to which it is attached and to which it is affixed and secured when in its closed relationship by tabs 152 securing hinged portion 142.

In order to close and secure the two covers 12 and 14, an end closure or flap 18 is shown. This end cover or flap 18 can be of any suitable form but in this instance has been shown as a flap that is hinged to the second major cover 14 by means of a living hinge 220. This can be seen in FIGS. 4 and 5. Living hinge 220 allows for an opening and closing of the flap 18 in the direction of the arrows as shown.

The flap or closure 18 is formed of a main wall portion 222 having a ledge or flange 224. The ledge or flange 224 can be seen in FIG. 3 as well as the showings of FIGS. 4 and 5. The ledge or flange 224 allows an insertion of the wall 30 so that it overlies the ledge or flange 224. It can be in resting contact therewith, sliding frictional engagement or provided in any other suitable manner. In the closure as shown, it is shown in a spaced relationship therefrom, but can be in a configuration so that it engages the wall in a tightened configuration and flexes inwardly and outwardly in conjunction with the closure securement means.

The closure securement means to hold the flap 18 in place, is provided with a tab 228 having a protuberance, tang or barb 230. This can be seen in the form of the tabs 228 in the FIG. 3 showing, as well as those in FIGS. 4 and 5.

The protuberance 230 passes through and engages interior portions of openings 38 and 40 of the wall 30. This can be seen in detail in FIGS. 4 and 5 with the opening 38 that receives the tab 228 and the protuberance, tang or barb 230 to allow for an overlapping engagement thereof for securing the end flap 18. In this manner, an outer ledge 238 which surrounds the top or first cover 12 is allowed to rest on the wall portion 222 of flap 18.

It should be understood that the ledge 238 which surrounds the first cover 12 is somewhat decorative and can be eliminated on the edge region or can be provided as in the manner shown. Also, ledge 240 as shown on the second major cover 14 can be utilized or eliminated, depending upon the desires of the end user.

Figure 9:
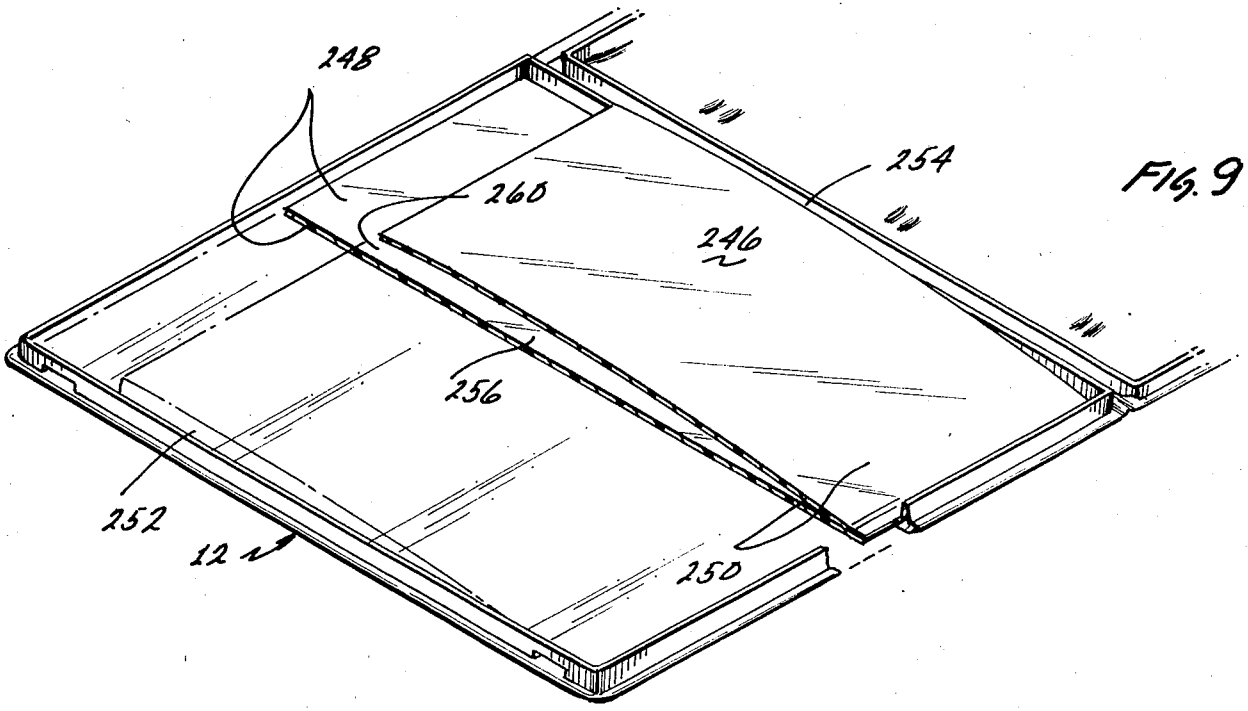

In an alternative embodiment, a pocket 246 of FIG. 9 is shown. The pocket 246 includes an inner wall portion 248 and an outer wall portion 250 that has been folded over and formed as a pocket with side walls 252 and 254 so as to allow for a space 256 between the inner wall 248 and outer wall 250.

The foregoing pocket with its walls can be cemented to the first cover 12 in any suitable manner so as to provide for supplemental insertion of material therein. Also, the distance of the spacing between the inner wall 248 and outer wall 250 at the opening 260 can be varied, depending upon the particular design and utilization of the material to be implaced in space 256.

The foregoing pocket construction can be of a blow molded plastic material, a vacuum formed material, or any other suitable configuration allowing flexibility and movement of the wall 250, so that material can be implaced in space 256.

As can be seen from the foregoing configuration, the magnetic media 176 can be inserted into the space 200 through the opening 174. The ring binder or other program or printed material holding means 72 can be utilized to hold a program in the form of program pages 73. The printed program pages 73 can be of any particular type, such as directions, hard copy, program layouts, or other instructions and aspects of a program which enhance the utilization and operation of the equipment to which the magnetic media 176 is to be accessed and used with.

Accordingly, the combination of the magnetic media cover and program storage means of this invention is substantially novel over the art for the utilization therewith in combination with various forms of computer apparatus. Thus, this invention should be read broadly as claimed hereinafter.

I claim:

1. A magnetic memory and printed material case comprising:

a first cover;

a second cover;

means for hinging said first and second cover together in the form of a binding having a living hinge and wherein said first and second covers are formed from one piece of plastic;

ring binder means for holding printed material attached to said case; and, a magnetic media pocket for storing magnetic media on the interior side of one of said covers when they are folded over each other so as to effectuate a holding of magnetic media in combination with printed material formed with a separate molded pocket cover and secured to one of said covers by attachment means thereto.

2. The case as claimed in claim 1 wherein:

said attachment means between said magnetic media pocket cover and said cover comprise a wall portion on said cover having a recess under a ledge; and, protuberances on said magnetic media cover which are received within said recesses under said ledges.

3. The case as claimed in claim 2 further comprising:

a flap closure means opposite from said hinge between said first and second covers for spanning between said first and second covers distally from said first and second cover hinge.

4. The case as claimed in claim 3 wherein said closure means comprises:

a flap that has been molded with said first and second cover means and said hinge between said first and second cover means, so as to provide one integral first and second cover hinge and closure flap associated therewith.

5. The case as claimed in claim 4 further comprising:

at least one opening within one of said covers; and, tab means attached to said flap closure having a protuberance for insertion into the opening of said cover for securement of said flap against said cover so as to provide a unitary cover substantially surrounding said magnetic media and printed material held between said first and second covers.

6. A magnetic media and associated document case comprising:

a first cover;

a second cover;

a flexible binding connecting said first and second cover by means of at least one living hinge formed with said first and second cover in an injection molding process;

a flap attached to one of said covers by a living hinge integrally formed with said first and second covers and said binding;

tab means on said flap to interface and connect with one of said covers on the side opposite from said attachment means to said covers for holding said covers, said binding, and said flap in a substantially surrounding relationship to material between said covers;

magnetic media storage means attached to one of said covers for holding magnetic media therein in associated relationship with said document holding means;

ribs surrounding at least a part of the periphery of each one of said covers on the interiorly closed side thereof; and, at least one opening in said rib for receipt of said tab means of said flap for closure of said flap with said second interfacing cover.

7. The case as claimed in claim 6 wherein:

said magnetic media storage means comprise a pocket formed on one of said covers having a movable flap attached thereto for enclosing magnetic media between said flap and one of said covers.

8. The case as claimed in claim 7 wherein:

said magnetic media storage pocket flap comprises a hinged member having means for attachment to said cover to which it is attached so as to be able to fold openly in part along a hinge point and allow magnetic media to be implaced therein between said attachment means and said pocket flap.

9. The case as claimed in claim 8 wherein said pocket attachment means comprises:

a member extending from the interior of said cover to which said pocket flap is attached;

tabs formed with said pocket cover; and, means for receiving said tabs of said pocket cover within said means extending from said cover.

10. The case as claimed in claim 9 wherein:

said attachment means extending from said cover comprise channel walls formed in part from said rib surrounding the periphery of said cover, and an interior wall therefrom to form a channel;

recesses within said ribs providing an opening for said tabs; and, wherein said tabs are formed on a walled rib extending at least in part around said pocket cover to be received in said channel so that said tabs can be inserted in said recesses and hold said pocket cover on said cover.

* * * * *